US008321972B1

(12) United States Patent
Vetter

(10) Patent No.: US 8,321,972 B1
(45) Date of Patent: Dec. 4, 2012

(54) EASILY ADJUSTABLE LIFTING BELT

(75) Inventor: Diane Lou Vetter, Tucson, AZ (US)

(73) Assignee: Diane Vetter, Tucson, AZ (US)

( * ) Notice: Subject to any disclaimer, the term of this patent is extended or adjusted under 35 U.S.C. 154(b) by 0 days.

(21) Appl. No.: 13/470,695

(22) Filed: May 14, 2012

(51) Int. Cl.
*A61G 7/10* (2006.01)

(52) U.S. Cl. ..... 5/81.1 R; 5/81.1 T; 5/89.1

(58) Field of Classification Search ..... 5/81.1, 5/89.1, 81.1 R, 81.1 T; 182/3; 128/876
See application file for complete search history.

(56) References Cited

U.S. PATENT DOCUMENTS

| | | | | |
|---|---|---|---|---|
| 4,446,943 | A | 5/1984 | Murray | |
| 4,739,526 | A | 4/1988 | Hollick | |
| 6,311,346 | B1 * | 11/2001 | Goldman | 5/81.1 T |
| 6,715,167 | B2 * | 4/2004 | Wake | 5/81.1 T |
| 7,360,543 | B1 | 4/2008 | Coleman et al. | |
| 2003/0140414 | A1 | 7/2003 | Wake | |
| 2003/0192118 | A1 | 10/2003 | Carbonneau et al. | |
| 2005/0263551 | A1 | 12/2005 | Dent, III | |
| 2009/0178194 | A1 | 7/2009 | Story | |
| 2012/0019015 | A1 | 1/2012 | Trader | |

* cited by examiner

*Primary Examiner* — Fredrick Conley

(57) ABSTRACT

A lifting belt comprising a waist belt and a detachable right and left leg strap is described. The lifting belt allows for quick and easy lifting of a person that has fallen, or is otherwise incapacitated. The lifting belt is configured with a plurality of lifting handles on the waist belt. The plurality of lifting handles allows a after to choose a handle that is in a suitable location for them to reach. The lifting handles are made of a woven fabric attached to the waist belt and a daisy chain configuration on the leg straps, so they are not uncomfortable to the fallen person. The lifting belt is adjustable in size, whereby an attachment device can connect a leg strap or waist belt by an end loop, daisy chain loop, or lifting handle. In one embodiment, the left and right leg straps are a different design, such as different colors, to allow for quick identification and coordination between lifters.

18 Claims, 4 Drawing Sheets

EASILY ADJUSTABLE LIFTING BELT

BACKGROUND OF THE INVENTION

1. Field of the Invention

The present invention relates to an easily adjustable lifting belt.

2. Background

Emergency personnel, hospital and nursing home staff are often required to lift a person that has fallen or has otherwise become incapacitated. Lifting a fallen person can be very difficult, physically awkward and dangerous. In many cases, people attempt to wrap their arms around the fallen person, or grab an arm or leg. This is uncomfortable to both the person doing the lifting and the fallen person. In other cases, a person has fallen into tight quarters, such as in a bathroom where there is little room to maneuver.

Emergency personnel are required to lift people that have fallen in any number of situations, including outdoors, such as while hiking or doing other outdoor activities. These situations, may pose even greater challenges and danger.

A person that has fallen may be of any size, and in some cases are very large. It is inconvenient and costly for emergency personnel, as well as hospital and nursing home staff, to carry lifting belts that come in various sizes. In addition, it may delay the rescue of a person if a lifting belt of the wrong size is initially selected.

There exists a need for a lifting belt that is adjustable in size and is quick and easy to fit to a person. In addition, there exists a need for a lifting belt that has many different lifting handles, whereby a person can select a handle position that is most conducive to their, and the fallen person's body position. Furthermore, there exists a need for a lifting belt that can be easily discerned by lifting persons, so that they can be more quickly directed where to lift.

SUMMARY OF THE INVENTION

The invention is directed to a lifting belt comprising a waist belt and both a right and left leg strap. The lifting belt, as described herein, allows for quick and easy lifting of a person that has fallen, or is otherwise incapacitated, and is configured with a plurality of lifting handles on the waist belt. The plurality of lifting handles allows a lifter to choose a handle that is in a suitable location for them to reach, and lift the fallen person. The lifting handles are made of material attached to the waist belt, so they are not uncomfortable to the fallen person.

The lifting belt, as described herein, is easy to put on a fallen person, as it is configured with a plurality places to connect the components, including the waist belt and leg straps. In one embodiment, the lifting belt, as described herein, may be separated into three pieces, the waist belt, and the left and right leg straps. One or both of the leg straps may be detachably attached to the waist belt. The waist belt may be fit around a fallen person's waist and an attachment device, such as a carabiner, may attach a first end loop to a second end loop, or to a lifting handle. In this way, the belt may quickly be adjusted in size, allowing it to fit comfortably around either a very large person or a petit person.

Likewise, both leg straps should be attached in the back of the waist belt to one of the lifting handles. The two leg straps need to be brought between the legs, or through the crotch region to the front of the person. The daisy chains on each leg are attached to the waist belt in the front of the person. Likewise, a leg strap may be attached to the waist belt in the front of a leg by an end loop or daisy chain and then wrapped through the crotch region of the fallen person and attached to an end loop or lifting handle on the waist belt in the back of the person. This type of attachment allows the leg strap to accommodate a wide range of sizes. A leg strap may be permanently attached to the waist belt at one point, allowing the free end to be configured through the legs, or crotch region, of the fallen person and attached to the waist belt through either an end loop or lifting handle. The left and right leg straps may comprise different designs, such as color, that allows a lifting person to quickly discern which leg strap someone directing the lifting operation refers to. For example, a directing person, who may also be a lifting person, may request that a second lifting person adjust the red, or left leg strap, and may request that a third lifting person adjust the blue, or right leg strap. An easily distinguishing design, such as a color, may allow for quicker coordination of lifting a person from a dangerous situation. Any suitable design may be used, however different colors may be sufficient. In addition, each lifting handle may have some distinguishing label, such as a number or letter, thereby allowing for further direction.

The waist belt and leg straps may have end loops that extend from the ends of the belt or strap and provide a place for attachment. An end loop may comprise an extended piece of material from the belt lifting handles material or strap daisy chain, or as used herein, a contiguous end loop, or may comprise a separate piece of material attached to the belt or strap.

Any suitable attachment device may be used to attach the components of the lifting belt, including, but not limited to, a carabiner, a clip, a hook, a buckle, a latch, any combination of attachments, and the like. A preferred attachment is a carabiner, as it can be quickly and easily attached and detached around one or more lifting handles or end loops.

The waist belt and leg strap are comprised of a main portion that may be any suitable material, such as a woven fabric, non-woven materials, webbing, elastomer, plastic band or film, a natural material, such as leather, a composite material, a combination of materials and the like. In a preferred embodiment, the main portion of the waist belt or leg strap comprises a webbing type woven fabric, as it is durable, strong, and comfortable.

Attached to the main portion of the waist belt are lifting handles, comprising any suitable material including, but not limited to, woven fabric, non-woven materials, webbing, elastomer, plastic band or film, a natural material, such as leather, a composite material, a combination of materials and the like. In a preferred embodiment, the lifting handles comprise a webbing type woven fabric, as it is durable, strong, and comfortable on a lifting persons hand while lifting a fallen person. In a preferred embodiment, the lifting handle portion consists of a continuous length of material attached to the waist belt main portion. Stated another way, in one embodiment, the lifting handles are configured from a single piece of lifting handle portion, or single piece of material attached to the main waist belt portion. Any suitable number of lifting handles may be configured on a waist belt, including, but not limited to, two, three, four, more than about five, more than about ten, more than about fifteen, more than about twenty, and any range between and including the number of lifting handles provided, such as between and including five to fifteen.

Attached to the main portion of the leg straps are daisy chains, or a plurality of loops. A daisy chain is a piece of material that is generally aligned with and attached to the main leg strap portion. A daisy chain is attached to a main leg strap portion by daisy chain attachments, such that loops, or excess length of the daisy chain material, are formed between daisy chain attachment locations. Any suitable number of daisy chain attachments may be configured on a leg strap, including, but not limited to, two, three, four, more than about five, more than about ten, more than about fifteen, more than about twenty, and any range between and including the number of lifting handles provided, such as between and including five to fifteen. As with the waist belt and lifting handle portion, the main leg straps portion and daisy chains may comprising any suitable material including, but not limited to, woven fabric, non-woven materials, webbing, elastomer, plastic band or film, a natural material, such as leather, a composite material, a combination of materials and the like. In a preferred embodiment, the main leg strap portion comprise a webbing type woven fabric, as it is durable, strong, and comfortable. In a preferred embodiment, a daisy chain consists of a continuous length of material attached to a main leg strap portion. Stated another way, in one embodiment, the daisy chain loops are configured from a single piece of daisy chain attached to the main leg strap portion.

In one embodiment, a waist belt consists essentially of woven fabric, whereby the main waist belt portion and lifting handle portion are made of woven fabric, and in particular a webbing type woven fabric. Likewise, in one embodiment, a leg strap consists essentially of woven fabric, whereby the main leg strap portion, and daisy chain are all made of woven fabric. In yet another embodiment, the lifting belt consists essentially of woven fabric, wherein both the waist belt and leg straps consist essentially of fabric. Consist essentially of, as used herein, means that the material of construction is fabric that may comprise small amounts of other materials, such as binder, or adhesives. In yet another embodiment, the wait belt main portion and lifting handle portion consist of a woven fabric or webbing. Similarly, in one embodiment, the leg straps main portions and daisy chains consist of a woven fabric or webbing.

Webbing, as used herein, means a woven fabric that is strong and durable. In one embodiment, webbing is made of synthetic material, such as plastic including, nylon, polyester, polypropylene, and the like.

Fabric, as used herein, means any suitable type of fabric including woven and non-woven fabric materials that are comprised of natural, and/or synthetic fibers or yarns. Any suitable weave may be used in the construction of the fabric. A preferred fabric is a woven synthetic fabric, as it is lightweight and durable.

The geometry of the lifting belt may be such that it fits a wide range of people. The waist belt may have any suitable length including, but not limited to, greater than about 0.5 m, greater than about 0.75 m, greater than about 1.0 m, greater than about 1.25 m, greater than about 1.5 m, greater than about 2 m, and range between and including the lengths provided. Likewise, a leg strap may have any suitable length including, but not limited to, greater than about 0.25 m, greater than about 0.5 m, greater than about 0.75 m, greater than about 1.0 m, greater than about 1.25 m, greater than about 1.5 m, and any range between and including the lengths provided. As described, the waist belt and leg straps may be configured around a person, and attached in any suitable location, such as an end loop, lifting handle, or daisy chain loop to provide a secure fit around the person needing to be lifted.

The main belt portion and the main leg strap portion of a lifting belt, as described herein, may be any suitable width including, but not limited to, greater than about 25 mm, greater than about 50 mm, greater than about 75 mm, greater than about 100 mm, greater than about 125 mm and any range between and including the widths provided. The main belt portion may be larger in width than a main leg strap portion. For example, a main belt portion may be 100 mm, and main leg strap portion may be 75 mm.

The daisy chain of a leg strap may have any suitable width including, but not limited to, greater than about 15 mm, greater than about 25 mm, greater than about 50 mm, greater than about 75 mm, greater than about 100 mm and any range between and including the widths provided. In a preferred embodiment, the daisy chain is configured with a width less than the width of the main leg strap portion. It may be preferable to keep the width of the daisy chain material to a minimum, thereby allowing for easier attachment of an attachment device to a daisy chain loop. In one embodiment, the daisy chain may have a variable width, whereby one portion of the daisy chain is more narrow than another portion.

The distance of gap between lifting handle attachments on the waist belt may be configured to have any suitable distance including but not limited to, greater than about 25 mm, greater than about 50 mm, greater than about 100 mm, greater than about 150 mm, and any range between and including the distance values provided. The handles may be configured to have any suitable stored length including, but not limited to, greater than about 50 mm, greater than about 75 mm, greater than about 100 mm, greater than about 150 mm, greater than about 200 mm, and any range between and including the stored lengths provide. In a preferred embodiment, the stored length is large enough to allow a person to easily fit their hand into the handle for lifting purposes. Stored length, as used herein, is the length of material, including lifting handle and daisy chain material, between attachments.

The daisy chain is attached to a main leg strap portion to produce daisy chain loops that may be used for attachment of attachment devices. The series of daisy chain loops allow the leg straps to be adjusted in size around a person's leg. The daisy chain attachments may be any suitable type of attachment, including, but not limited to, stitches, staples, clips, fasteners, welds, and any combination of attachments. In a preferred embodiment, the daisy chain attachments are stitches, as stitches do not pose any cutting risk as a staple or clip may. Furthermore, the daisy chain attachment may consist essentially of stitches, whereby the stitches are comprised of thread.

The summary of the invention is provided as a general introduction to some of the embodiments of the invention, and is not intended to be limiting. Additional example embodiments including variations and alternative configurations of the invention are provided herein.

BRIEF DESCRIPTION OF THE DRAWINGS

The accompanying drawings are included to provide a further understanding of the invention and are incorporated in and constitute a part of this specification, illustrate embodiments of the invention, and together with the description serve to explain the principles of the invention.

DETAILED DESCRIPTION OF THE ILLUSTRATED EMBODIMENTS

Figure 1:
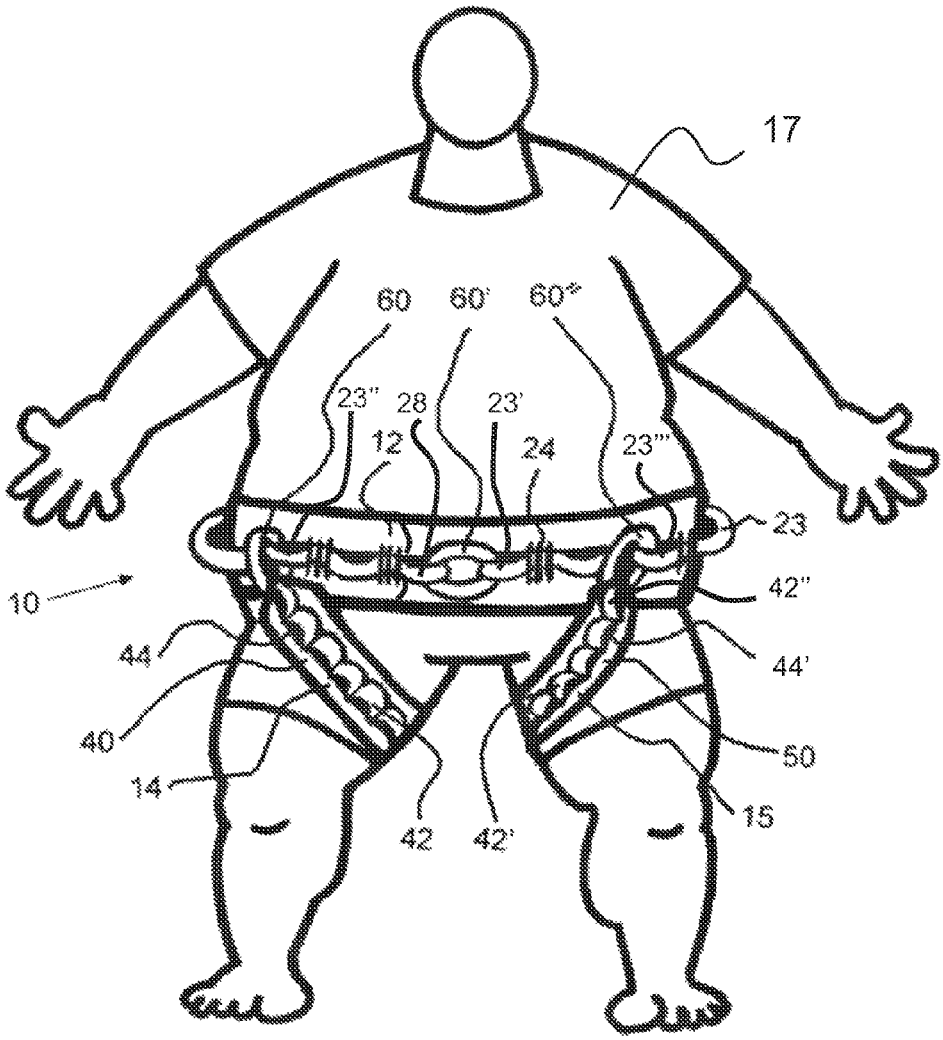

FIG. 1 shows a front view of a person wearing an exemplary embodiment of a lifting belt comprising a waist belt and a right and left leg strap attached, as described herein.

Figure 2:
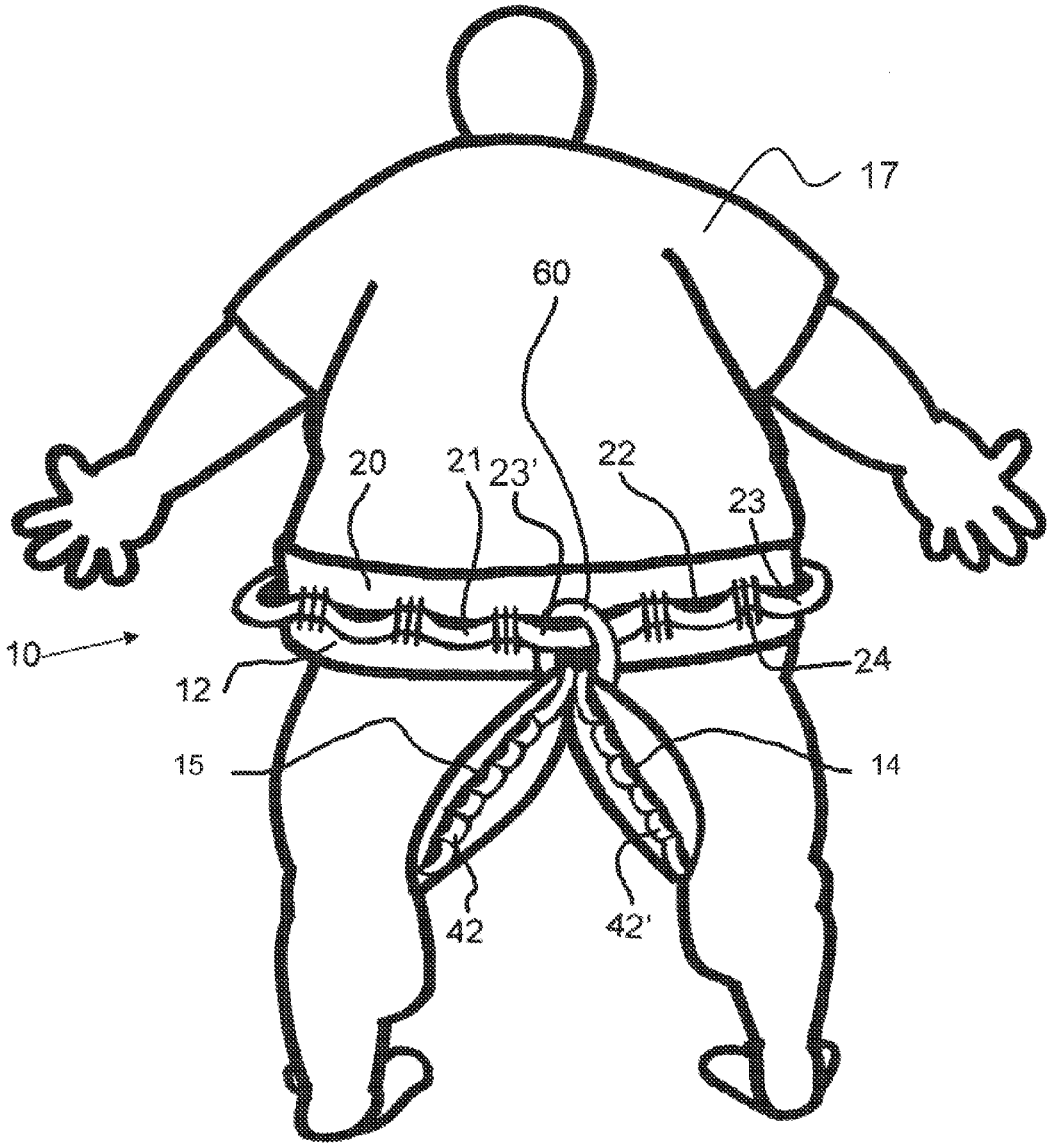

FIG. 2 shows a back view of a person wearing an exemplary embodiment of a lifting belt comprising a waist belt and a right and left leg strap attached, as described herein.

Figure 3A:
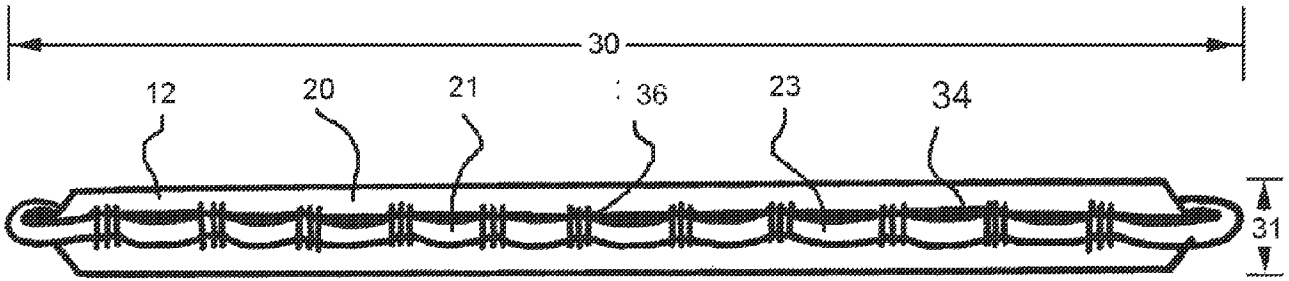

FIG. 3A shows a top view of an exemplary waist belt having a daisy chain of material attached thereto and handles.

Figure 3B:
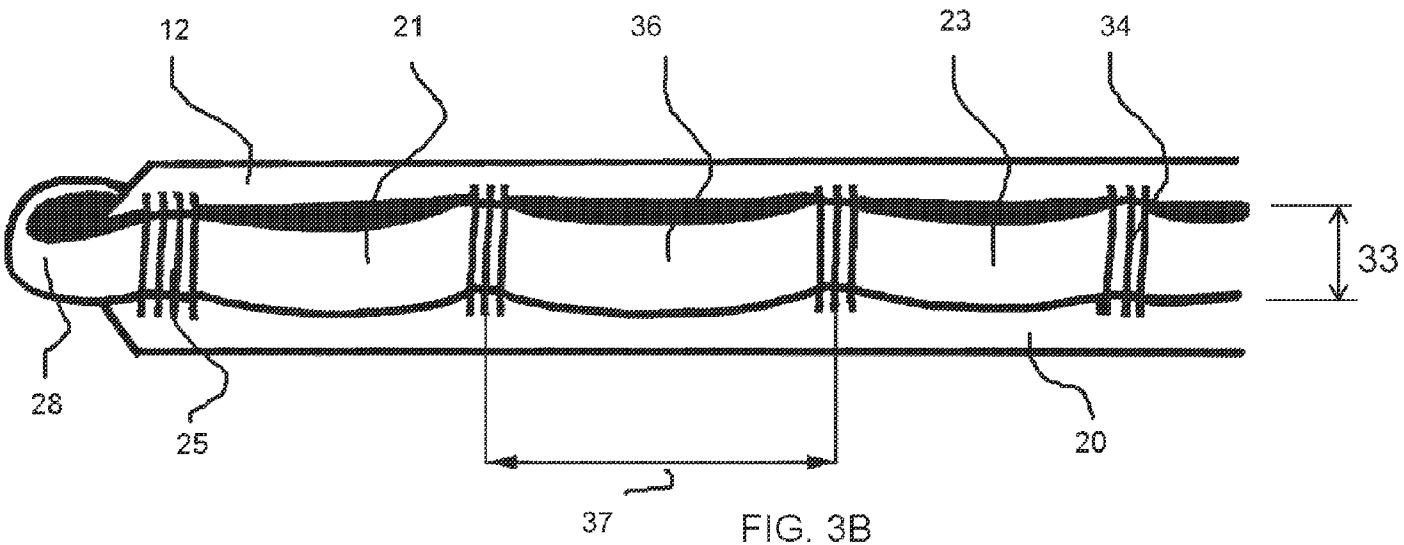
Figure 4A:
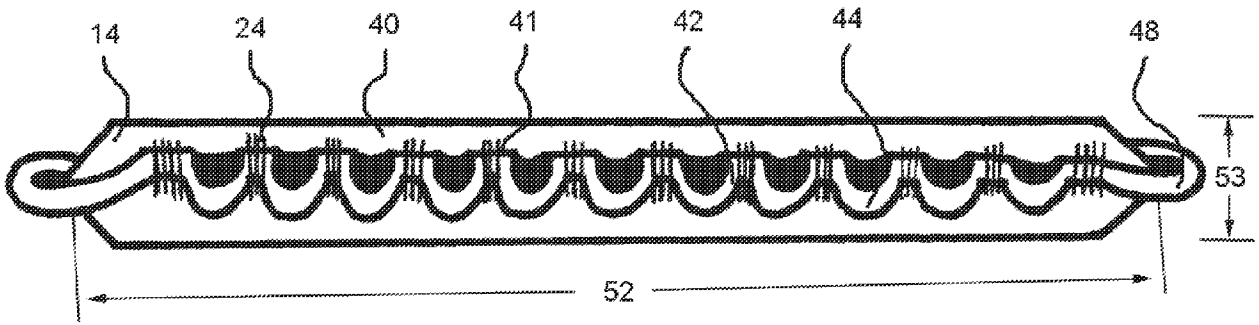

FIG. 3B shows an expanded view of the waist belt shown in FIG. 3A,

FIG. 4A shows a top view of an exemplary leg strap having a daisy chain of material attached thereto.

Figure 4B:
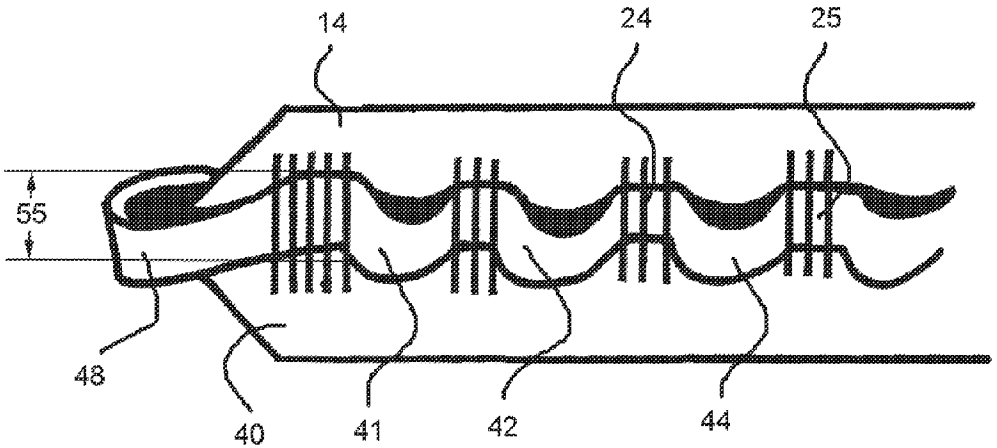

FIG. 4B shows an expanded view of the leg strap shown in FIG. 4A.

Corresponding reference characters indicate corresponding parts throughout the several views of the figures. The figures represent an illustration of some of the embodiments of the present invention and are not to be construed as limiting the scope of the invention in any manner. Further, the figures are not necessarily to scale, some features may be exaggerated to show details of particular components. Therefore, specific structural and functional details disclosed herein are not to be interpreted as limiting, but merely as a representative basis for teaching one skilled in the art to variously employ the present invention.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Also, use of "a" or "an" are employed to describe elements and components described herein. This is done merely for convenience and to give a general sense of the scope of the invention. This description should be read to include one or at least one and the singular also includes the plural unless it is obvious that it is meant otherwise.

Certain exemplary embodiments of the present invention are described herein and illustrated in the accompanying figures. The embodiments described are only for purposes of illustrating the present invention and should not be interpreted as limiting the scope of the invention. Other embodiments of the invention, and certain modifications, combinations and improvements of the described embodiments, will occur to those skilled in the art and all such alternate embodiments, combinations, modifications, improvements are within the scope of the present invention.

DEFINITIONS

Connect, as defined herein, means that the attachment device physically secures two elements of the invention together including, but not limited to, a lifting handle, an end loop, another attachment device and a daisy chain loop.

Main portion, as used herein, may refer to a waist belt main portion, and/or a leg strap main portion.

As show in FIG. 1, a lifting belt 10, as described herein, is configured on a person 17. The waist belt 12 is shown encircling the person's waist, and the leg straps, 14 and 15, are shown being connected to the waist belt 12 and extending through and partially around the person's legs. The waist belt 12 comprises a main belt portion 20 and a lifting handle portion 21, as shown in FIG. 2. The lifting handle portion 21 is comprises of a series of lifting handles 22 made from a piece of material attached to the main belt portion 20. As shown in FIG. 1, an attachment device 60' is shown attaching an end loop 28 of the waist belt 12 to a lifting handle 23'. Another attachment device 60 is shown attaching a right leg strap 14 daisy chain loop to a waist belt lifting handle 23". A third attachment device 60" is shown attaching a left leg strap 15 daisy chain loop 42" to a waist belt lifting handle 23". The attachment devices shown in FIG. 1 are carabiners 60. As shown in FIG. 1, there are a number of lifting handles configured on the front of the waist belt to allow a lifting person to grab and lift the person 17. The leg strap daisy chains 44, 44', provide incremental places along the length of the leg strap for attachment, thereby enabling the lifting belt to fit a wide size range. In one embodiment, the lifting handles 23 and end loops 28 are made from a single piece of material, whereby the end loops are contiguous with said lifting handles.

FIG. 2 shows a back view of a person 17 wearing an exemplary embodiment of a lifting belt 10 comprising a waist belt 12, and attached right 14 and left leg straps 15, as described herein. Both the right and left leg strap, 14 and 15 respectively, are connected by a single attachment device 60, to a lifting handle 23' on the waist belt 12. Any suitable lifting handle on the waist belt may be used for connection, thereby allowing for a suitable fit around a person. In addition, in some cases an attachment device may connect an end loop of a leg strap 48, not shown, to either an end bop or lifting handle of the waist band.

FIG. 3A shows a top view of an exemplary waist belt 12 having a lifting handle material 36 attached to a main belt portion 20, thereby forming waist belt lifting handles 23. The lifting handle material 36 is generally aligned in parallel with and attached to the main belt portion. The lifting handle attachments 34 as shown in FIG. 33, are generally perpendicular to the lifting handle material 36. The lifting handle attachments shown in FIG. 3B are stitches 25. However, any suitable type of attachment may be used including but not limited to, staples, rivets, grommets, adhesive, welds, dips, fasteners and the like. The length and width of the main belt portion, 30 and 31 respectively, are shown in FIG. 3A. The length 30 is the distance from a first end of the main belt portion to the opposing or second end. The end loops 28, may extend beyond the ends as shown in FIG. 3A and FIG. 3B In one embodiment, an end loop is contiguous with said lifting handle material, which means that the end loop is simply an extension of the lifting handle material from the end of the waist belt and is attached to the waist belt to form an end loop.

FIG. 3B shows an expanded view of the waist belt shown in FIG. 3A. The stitch 25 type handle attachments 34 can be more dearly seen. The distance 37 between lifting handle attachments 34 may be substantially the same along the length of the wait belt or may vary, wherein the distance between a first set of lifting handle attachments is larger than the distance between a second set of lifting handle attachments. The width 33 of the lifting handle material, such as webbing, is shown in FIG. 3B.

FIG. 4A shows a top view of an exemplary leg strap 14 having a leg strap daisy chain 44 comprising a leg strap portion 41 attached to the main leg strap portion 40. The daisy chain attachments 24 form a plurality of daisy chain loops 42 along the length 52 of the leg strap. The daisy chain loops 42 provide incremental attachment locations along the length of the leg strap 14. The width 53 of the leg strap main portion is shown in FIG. 4A and the width 55 of the leg strap daisy chain 44 is shown in FIG. 43. The width of the daisy chain 44 may be configured to be less than the width 53 of the main portion 40. For example, the width of the leg strap daisy chain may be no more than the width of the main portion 40 or no more than three quarter, half, or a quarter of the width of the main portion 40. The daisy chain attachments 24, are shown as a stitch type 25 attachments. Again, any suitable type of attachment may be used including, staples, clips, rivets, fasteners, welds, adhesives, and the like. In one embodiment, a leg strap end loop 48 is an extension of the daisy chain material or is a contiguous type end loop. A separate piece of material may be used to form the leg strap end loop however.

The leg straps may comprise a design, such as an identifying color. For example the right leg strap may be red and the left leg strap may be blue. Any suitable color or design, including a plurality of colors may be used to distinguish a left leg strap from a right leg strap. In embodiment, the left leg strap has a camouflage design and the right leg strap has a striped multi-colored design.

EXAMPLE 1

A lifting belt, as described herein, was constructed having a simple design comprising three main components: a waist belt and two leg straps. All three components were different colors.

A waist belt was designed using a unique continuous row of lifting handles. The waist belt was made with (3-inch) 50.8 mm wide nylon webbing from LOWY Enterprises, Inc (Rancho Dominguez, Calif.). The 3-inch wide nylon webbing was the base of the waist belt. The waist belt was approximately (6 feet) 1.82 meters long. The breaking strength of the 3-inch webbing was approximately 9,000 pounds.

Sewn to the 3-inch wide nylon webbing was (1 inch) 25 mm wide nylon webbing, available from Country Brook Design. The webbing was double thick, meaning one length of the webbing was sewn on top of another length of webbing. The breaking strength of the combined 1 inch wide webbing was approximately 8,000 pounds. The length of the webbing was approximately (102 inches) 2.59 meters.

This double thick webbing was sewn onto the 3-inch waist belt webbing in (4 inch) 101.6 mm segments, as generally depicted in FIGS. 3A and 3B to produce lifting handles. The 4 inch space between the handle attachments provided enough room to allow a hand to slide between the 1-inch and 3-inch webbing. Each handle attachment was comprised of three bar tacks (sewn segments). A Consew Straight Stitch Walking Foot sewing machine was used to sew the 1-inch webbing pieces on top of each other. A Brother 311 Bar Tack Computer Driven sewing machine was used to attach the 1 inch webbing to the waist belt. The thread used for all of the sewing was 138 wt, nylon thread.

At each end of the waist belt, the 3-inch webbing corners were folded under to form a point at each end, as shown in FIG. 3A. The 1-inch webbing was then looped around the end of the belt and bar tacked to the backside of the 3-inch webbing to form an end loop. This process was performed on each end of the waist belt.

There were two components to the leg straps. One red right leg strap and one blue left leg strap. The leg straps were made with (2 inch) 50.8 mm wide nylon webbing from Direct Tex Inc. (Anniston, Ala.). The 2 inch wide webbing was the base of the leg strap. Each leg strap was approximately (4 feet) 1.22 meters long. The 2 inch webbing had a breaking strength of approximately 6,000 pounds.

The same (1 inch) 25 mm wide, double thick webbing, as used for the waist belt lifting handle material, was sewn on top of the 2 inch wide webbing to form a daisy chain. The spacing between the daisy chain attachments was (2 inch) 50.8 mm. There were three bar tacks per each daisy chain attachment point. At the end of each leg strap, the 2 inch wide webbing corners were folder under to form a point. The 1 inch wide webbing was then looped around the end and bar tacked to the backside of the 2 inch webbing to form an end loop. Each leg strap had two end loops made of 1 inch wide webbing.

The waist belt was secured around the person using a high strength carabiners, Black Diamond Positron Carabiners available from Black Diamond Equipment Inc. (Salt Lake City, Utah). The leg straps were attached to the waist belt by clipping a carabiner to one of the daisy chain loops that run the length of the leg strap. A carabiner was then used to attach the leg straps to the waist belt handles, both at the front and back of the person.

It will be apparent to those skilled in the art that various modifications, combinations and variations can be made in the present invention without departing from the spirit or scope of the invention. Specific embodiment, features and elements described herein may be modified, and/or combined in any suitable manner. Thus, it is intended that the present invention cover the modifications, combinations and variations of this invention provided they come within the scope of the appended claims and their equivalents.

What is claimed is:

1. An article comprising a lifting belt comprising:

a. a waist belt comprising;

i. a main belt portion;

ii. a lifting handle portion attached to said main belt portion comprising a plurality of waist belt lifting handles;

b. a right leg strap and left leg strap comprising:

i. a main leg strap portion;

ii. a daisy chain portion attached to said main leg strap portion to create a plurality daisy chain loops;

iii. at least one end loop; and c. a plurality of attachment devices, whereby said right leg strap and left leg straps are configured to be connected with said waist belt by said attachment devices and wherein the said at least one end loop is contiguous with said daisy chain.

2. The article of claim 1, wherein the lifting handle portion comprises a single piece of material attached to said main waist belt portion, whereby said plurality of lifting handles are configured therefrom.

3. The article of claim 1, wherein the daisy chain portion comprises a single piece of material attached to said main leg strap portion, whereby said plurality of daisy chain loops are configured therefrom.

4. The article of claim 1, wherein the right and left leg straps are detachable from said waist belt.

5. The article of claim 1, wherein the attachment devices are carabiners.

6. The article of claim 1, wherein said lifting handles are different sizes.

7. The article of claim 1, wherein the waist belt comprises at least one end loop.

8. The article of claim 7, wherein the at least one end loop is contiguous with said lifting handle portion.

9. The article of claim 1, wherein the waist main belt portion is comprised of a woven fabric having a width and length.

10. The article of claim 9, wherein the waist belt lifting handle portion is comprised of a woven fabric having a width that is less than the width of the waist main belt portion.

11. The article of claim 1, wherein the waist belt consists essentially of fabric.

12. The article of claim 1, wherein both the left and right leg straps consist essentially of fabric.

13. The article of claim 1, wherein said lifting belt consists essentiaUy of a woven fabric.

14. The article of claim 1, wherein the right leg strap is a first color and the left leg strap is a second color, wherein the first color is different from the second color.

15. The article of claim 1, wherein said lifting handles are substantially the same size.

16. An article comprising a lifting belt comprising:

a. a waist belt comprising;

i. a main belt portion;

ii. a lifting handle portion attached to said main belt portion comprising a plurality of waist belt lifting handles:

b. a right leg strap and left leg strap comprising:

i. a main leg strap portion;

ii. a daisy chain portion attached to said main leg strap portion to create a plurality daisy chain loops;

iii. at least one end loop; and c. a plurality of attachment devices, wherein said lifting handle portion comprises a single piece of material attached to said main waist belt portion, whereby said plurality of lifting handles are configured therefrom, wherein the daisy chain portion comprises a single piece of material attached to said main leg strap portion, whereby said plurality of daisy chain loops are configured therefrom, wherein the said at least one end loop is contiguous with said daisy chain, whereby said right leg strap and left leg straps are configured to be connected with said waist belt by said attachment devices, and wherein the right leg strap is a first color and the left leg strap is a second color, wherein the first color is different from the second color.

17. The article of Maim 16, wherein the right and left leg straps are detachable from said waist belt.

18. The article of claim 16, wherein the waist belt is at least 1 m in length.

* * * * *